US009200769B2

(12) United States Patent
O'Briant-Teague

(10) Patent No.: US 9,200,769 B2
(45) Date of Patent: Dec. 1, 2015

(54) DECORATIVE SYSTEM

(71) Applicant: Liddo S. O'Briant-Teague, Las Vegas, NV (US)

(72) Inventor: Liddo S. O'Briant-Teague, Las Vegas, NV (US)

( * ) Notice: Subject to any disclaimer, the term of this patent is extended or adjusted under 35 U.S.C. 154(b) by 17 days.

(21) Appl. No.: 13/941,461

(22) Filed: Jul. 13, 2013

(65) Prior Publication Data

US 2015/0016111 A1 Jan. 15, 2015

(51) Int. Cl.

| | |
|---|---|
| ***F21S 4/00*** | (2006.01) |
| ***F21V 21/00*** | (2006.01) |
| ***A47G 33/06*** | (2006.01) |
| *F21W 121/00* | (2006.01) |
| *F21W 121/04* | (2006.01) |
| *F21Y 101/02* | (2006.01) |

(52) U.S. Cl.

CPC ..... *F21S 4/001* (2013.01); *A47G 33/06* (2013.01); *F21W 2121/00* (2013.01); *F21W 2121/006* (2013.01); *F21W 2121/04* (2013.01); *F21Y 2101/02* (2013.01)

(58) Field of Classification Search

CPC ..... F21S 4/001; A47G 33/06; F21Y 2101/02; F21W 2121/04; F21W 2121/006; F21W 2121/00

See application file for complete search history.

(56) References Cited

U.S. PATENT DOCUMENTS

| | | | | |
|---|---|---|---|---|
| 2,806,938 | A * | 9/1957 | Henry | 40/431 |
| 3,766,376 | A * | 10/1973 | Sadacca et al. | 40/433 |
| 5,558,422 | A * | 9/1996 | Sanford | 362/565 |
| 6,652,927 | B1 * | 11/2003 | Chen | 428/7 |
| 7,163,725 | B2 * | 1/2007 | Johnson et al. | 428/20 |
| 2007/0041184 | A1 * | 2/2007 | Lavy et al. | 362/216 |
| 2007/0076438 | A1 * | 4/2007 | Chien | 362/641 |
| 2008/0273348 | A1 * | 11/2008 | Klohn et al. | 362/567 |
| 2012/0224372 | A1 * | 9/2012 | Ogawa et al. | 362/249.01 |
| 2013/0279155 | A1 * | 10/2013 | Kuroda et al. | 362/97.4 |

* cited by examiner

*Primary Examiner* — Donald Raleigh

(57) ABSTRACT

A decorative system that provides malleable decorative rods that bend, illuminate, and extend from an electrical base to form a decorative object, such as a Christmas tree. The malleable properties of the rods provide sufficient flexibility to bend and manipulate until a desired shape and dimension is achieved. The rod comprises at least one protrusion to help enhance a desired decorative effect such as pine needles that provide the look and feel of garlands. The rod also includes at least one illumination for illuminating the system. A base portion, from which the at least one rod extends, provides power to the rod. The base portion includes a threaded metal base that joins with a matching electrical socket, similar to an Edison base screw. At least one aperture and a cover provide a foundation into which the rods may be secured.

19 Claims, 5 Drawing Sheets

DECORATIVE SYSTEM

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to decorative systems. More particularly, the invention relates to decorative systems that provide at least one illuminated rod that extends from a base that joins with an electrical socket.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that decorative plants are plants that are grown for decorative purposes, as houseplants, for cut flowers and specimen display. Often, ornamental garden plants are grown for the display of aesthetic features including: flowers, leaves, scent, overall foliage texture, fruit, stem and bark, and aesthetic form.

Typically, a Christmas decoration is any of several types of decorations used at Christmas time. The traditional colors of Christmas are forest green, snow white, and heart red. Typical icons of the holiday include Baby Jesus, Santa Claus, and the star of Bethlehem. Typical winter icons include snowflakes, snowmen, icicles, and even penguins and polar bears.

In many cases, a wire is a single, usually cylindrical, flexible strand or rod of metal. Wires are used to bear mechanical loads and to carry electricity and telecommunications signals. Wires are often sufficiently malleable to form a desired shape. Wires may also carry objects used for aesthetic designs, including artificial leaves.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A illustrates the base portion from a bottom view, and FIG. 2B illustrates the base portion form a top view, in accordance with an embodiment of the present invention;

Figure 1A:
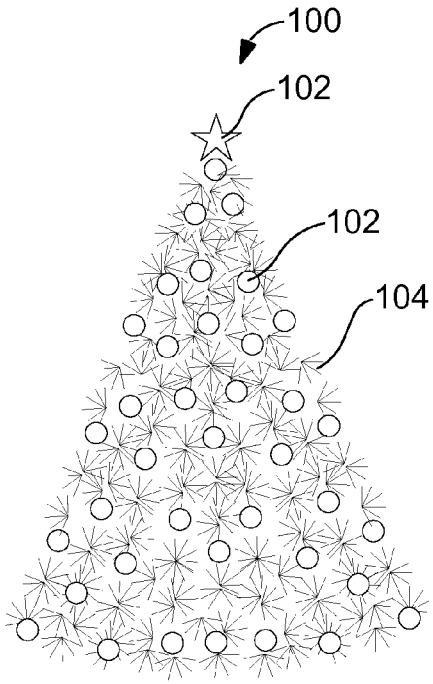
FIGS. 1A and 1B illustrate detailed perspective views of exemplary decorative systems with an exemplary at least one illumination portion powered on and powered off, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The present invention will now be described in detail with reference to embodiments thereof as illustrated in the accompanying drawings.

There are various types of decorative systems that may be provided by preferred embodiments of the present invention. In one embodiment of the present invention, the decorative system may provide malleable decorative rods that bend, illuminate, and extend from an electrical base to form a decorative object, including, without limitation, a Christmas tree, a garland, a plant, a wreath, a birthday decoration, and a night light. The malleable properties of at least one rod provide sufficient flexibility to bend and manipulate each rod until a desired shape and dimension is achieved. The at least one rod comprises at least one protrusion to help enhance a desired decorative effect. For example, without limitation, in one embodiment these protrusions may look like pine needles so that, if the rod is covered in these protrusions resembling pine needles, the actual rod may look like a strand of garland. In some embodiments, multiple rods that resemble garland may be assembled to form a product that looks like a small Christmas tree. In other embodiments, the protrusions may be made in a multiplicity of suitable forms to create various different decorative effects including, without limitation, pine tree needles, garlands, leaves, pine cones, fruit, nuts, stars, and figurines. The at least one rod may further include at least one illumination portion for further aesthetics and decoration. It is contemplated that various different types of illumination may be used such as, but not limited to, LEDs, incandescent lighting, fluorescent lighting, halogen lighting, etc. and in all forms in which these light types are available such as but not limited to individual bulbs, tubes, strands of lights, etc. The base from which the at least one rod extends may provide power to the at least one rod. In one embodiment, the base may include a threaded metal base that joins with a matching electrical socket. At least one aperture and a cover provide a foundation into which the at least one rod may be secured. In some embodiments the rods may be permanently secured into place during the manufacturing process so that the rods protrude from the apertures. In these embodiments the consumer will typically not need to install the rods, or really have any set-up. The consumer will typically only have to twist the base into a standard lamp socket. In some alternate embodiments, the rods may be removably secured in place, for example without limitation with a threaded connection.

In one embodiment of the present invention, a base portion may provide a foundation for the decorative system. The base portion may include a threaded metal base that joins with a matching electrical socket. For example, without limitation, an Edison screw base. The base portion may include a mounting end for joining with the electrical socket. The base portion may include a threaded neck section that extends through a female section of the electrical socket, wherein rotation of the base portion in a first direction urges the mounting end downwardly into engagement with the electrical socket. In this manner, power may be provided to the decorative system. In some embodiments, the base portion may include a neck end for the at least one rod to extend from. The neck end may include a cover for restricting access to the interior of the base portion. At least one aperture may position on the cover. The at least one aperture may be configured to receive one end of the at least one rod. In this manner, the at least one rod may at least partially engage the electrical components from the electrical socket.

In one embodiment of the present invention, at least one rod may extend from the at least one aperture. The at least one rod may include, without limitation, a wire, a cable, and a fiber optic cable. The at least one rod may be sufficiently rigid to support objects, yet also sufficiently malleable to bend to a desired form and shape. In some embodiments, the at least one rod may be circular in cross-section. However, the at least one rod may also form, without limitation, square, hexagonal, and flattened rectangular cross-sections. In some embodiments, each rod may include at least one protrusion for enhancing the decorative features. The at least one protrusion may include, without limitation, pine needles, garlands, leaves, flowers, branches, etc. At least one appendage may attach to the at least one protrusion. The at least one appendage may include, without limitation, fruit, nuts, stars, animals, Christmas ornaments, snowflakes, and figurines. For example, without limitation, pine tree needles, garland, and leaves may cover each rod to give the illusion of branches from a tree. An occasional figuring may also extend from each rod to provide additional decorative effects. In some embodiments, at least one illumination may extend from the at least one rod. The at least one illumination may include, without limitation, light emitting diodes, bulbs, incandescent lighting, fluorescent lighting, fiber optics, and candles. The power source from the electrical socket, which joins with the base portion, may power the at least one illumination. In one embodiment, the synergy created between the at least one illumination, the at least one protrusion, and the malleable shape of the at least one rod may create a visual effect of a Christmas tree.

Figure 1B:
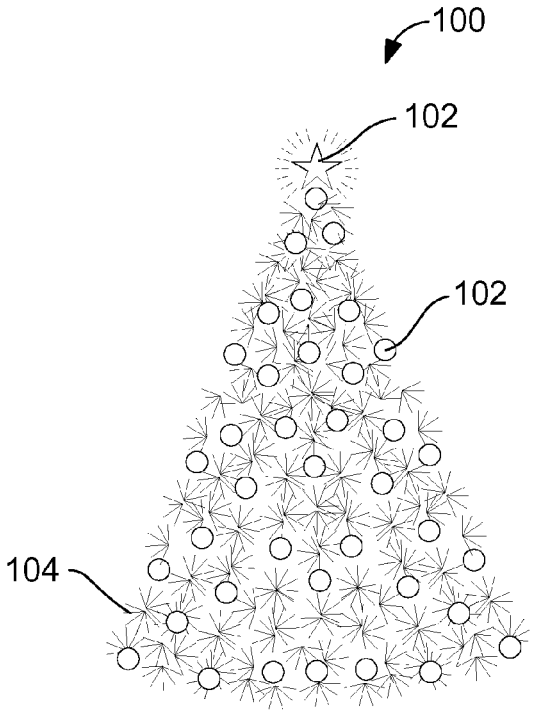

FIGS. 1A and 1B illustrate detailed perspective views of exemplary decorative systems with an exemplary at least one illumination portion 102 powered on and powered off, in accordance with an embodiment of the present invention. In the present embodiment, a decorative system 100 may provide malleable decorative rods that bend, illuminate, and extend from an electrical base to form a decorative object, including, without limitation, a Christmas tree, a garland, a plant, a wreath, a birthday cake, and a night light. In one embodiment, the at least one rod may be configured to make the decorative system appear as various types of evergreen Christmas trees, including without limitation, fir, pine and spruce. The malleable properties of at least one rod provide sufficient flexibility to bend and manipulate each rod until a desired shape and dimension is achieved. The at least one rod comprises at least one protrusion 104 to help enhance a desired decorative effect. For example, without limitation, in one embodiment the at least one protrusion 104 may look like pine needles so that, if the rod is covered in the at least one protrusion 104, it may resemble pine needles, while the actual rod may look like a strand of garland. In some embodiments, multiple rods that resemble garland may be assembled to form a product that looks like a small Christmas tree. In some embodiments, the at least one protrusion 104 may be made in a multiplicity of suitable forms to create various different decorative effects including, without limitation, pine tree needles, garlands, leaves, pine cones, fruit, nuts, stars, and figurines. The at least one rod may further include at least one illumination portion 102 for further aesthetics and decoration. The base portion from which the at least one rod extends may provide power to the at least one rod. In one embodiment, the base portion may include a threaded metal base that joins with a matching electrical socket. At least one aperture and a seal provide a foundation in which the at least one rod may be secured. The base portion may join with an electrical socket to provide power to the at least one rod. In this manner, the decorative system may illuminate, or remain without illumination portion, as desired.

Figure 2A:
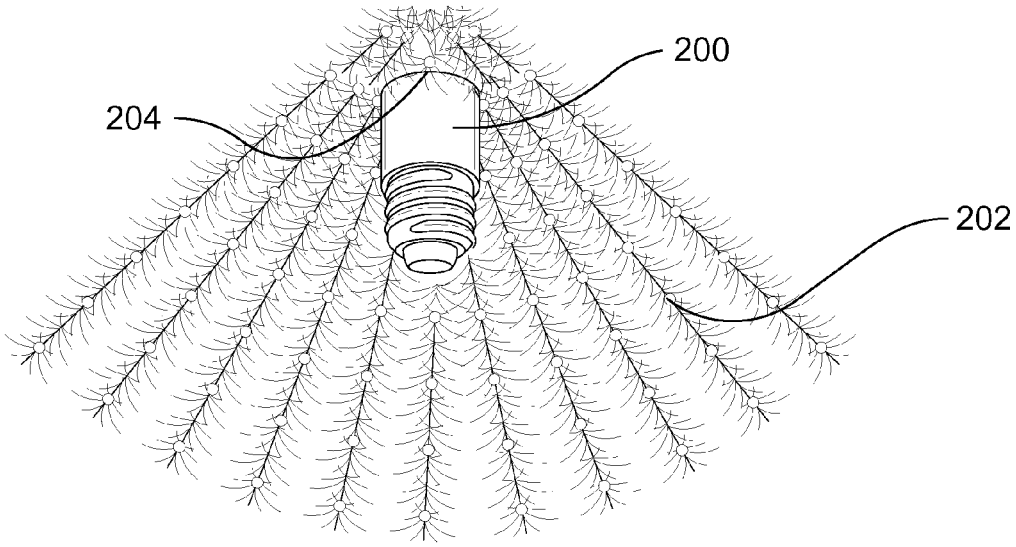
FIGS. 2A and 2B illustrate detailed perspective views of an exemplary base portion, where
Figure 2B:
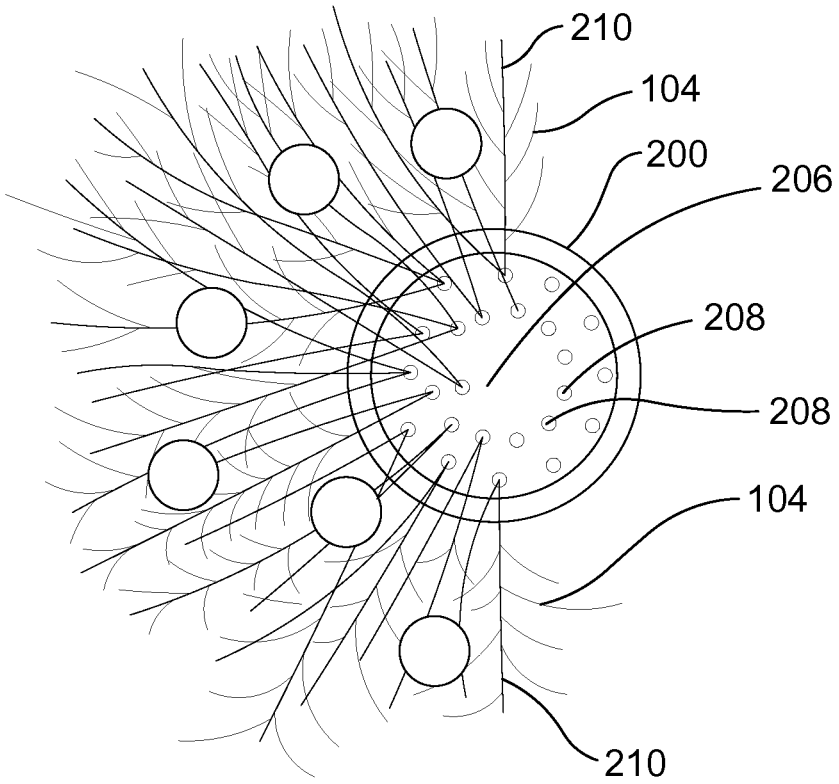

FIGS. 2A and 2B illustrate a bottom detailed perspective view of an exemplary base portion joined with an exemplary at least one rod and a top view of an exemplary base portion with an exemplary at least one aperture, respectively, in accordance with an embodiment of the present invention. In the present embodiment, a base portion 200 may provide a foundation for the decorative system 100. The base portion 200 may include without limitation a mounting end 202 for joining with the electrical socket. The base portion 200 may also comprise a threaded neck section that extends through a female section of the electrical socket, wherein rotation of the base portion 200 in a first direction urges the mounting end downwardly into engagement with the electrical socket. The base portion 200 may also include without limitation a threaded metal base that joins with a matching electrical socket. For example, without limitation, a 26 millimeter diameter format (E26) Edison screw base. In this manner, power may be provided to the decorative system 100. In some embodiments, the base portion 200 may include a neck end 204 from which the at least one rod 210 may extend. Referring to FIG. 2B, base portion 200 may comprise a cover or seal 206 for restricting access to the interior of base portion 200. The cover or seal 206 may be permanently affixed into place and may be fabricated from a material sufficiently rigid to protect the interior components, including, without limitation, thermoset melamine, high density polymer, polyvinyl chloride, fiberglass, rubber, metal, wood, etc. At least one aperture 208 may be positioned on the cover or seal 206. The at least one aperture 208 may be positioned on the cover or seal 206 to hold the at least one rod 210; whereby the at least one rod 210 may extend from the at least one aperture 208. In one embodiment, the at least one rod 210 may extend and be pointed in a direction and orientation efficacious for replicating the branches of a Christmas tree. The at least one rod 210 may extend from the at least one aperture 208. The at least one aperture 208 may include a peripheral insulation to help protect the at least one rod 210, and to typically provide a tight fit for securely holding the at least one rod 210. In this manner, the at least one rod 210 may at least partially engage the electrical components from the electrical socket. The at least one rod 210 may extend from the at least one aperture 208, exhibiting at least one protrusion 104 for decorative effects.

Figure 3:
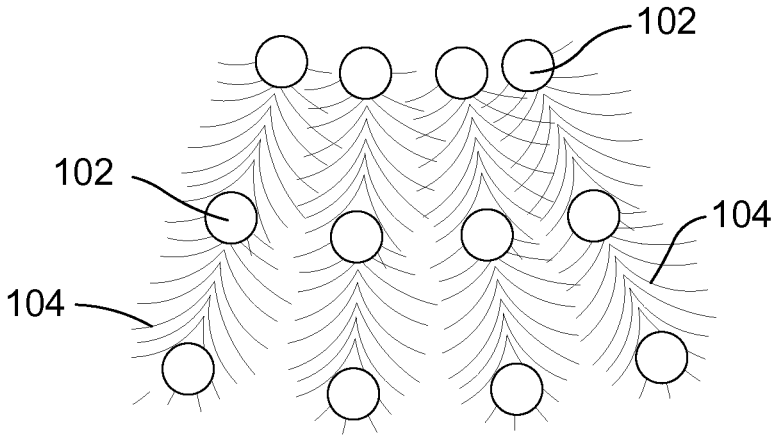
FIG. 3 illustrates a detailed perspective view of an exemplary at least one rod joined with an exemplary at least one illumination portion, in accordance with an embodiment of the present invention.

FIG. 3 illustrates a detailed perspective view of an exemplary at least one rod 210 joined with an exemplary at least one illumination portion 102, in accordance with an embodiment of the present invention. In the present embodiment, at least one rod 210 may extend from the at least one aperture 208. In one embodiment, the at least one rod 210 may include twelve to twenty-five wires of 10" length, attached to the base portion 200. The at least one rod 210 may include, without limitation, a wire, a cable, and a fiber optic cable. The at least one rod 210 may be sufficiently rigid to support objects, yet also sufficiently malleable to bend to a desired form and shape. For example, without limitation, the at least one rod 210 may initially extend perpendicular to the cover for a few inches, then bend at a 45 degree sloping angle to form the shape of a tree. However, in other embodiments, the at least one rod 210 may be bent and manipulated to provide myriad shapes, including, without limitation, spirals, loops, squares, vortexes, and annular shapes. In some embodiments, the at least one rod 210 may be circular in cross-section. However, the at least one rod 210 may also form, without limitation, square, hexagonal, and flattened rectangular cross-sections. In some embodiments, the at least one rod 210 may be made from a multiplicity of suitable material such as, but not limited to, copper, tungsten, aluminum, silver, silver alloys, gold, polymers and carbon nanotubes.

In one embodiment of the present invention, each rod 210 may include at least one protrusion 104 for enhancing the decorative features. For example, without limitation, these protrusions 104 may look like pine needles, garlands, leaves, flowers, branches, etc. In some embodiments, the at least one protrusion 104 may comprise a forest green color, and be fireproof. In some embodiments, an external covering or coating may at least partially enclose the at least one rod 210 to provide insulation and aesthetic features. For example, without limitation, the external covering or coating may comprise a forest green, polypropylene member that at least partially covers each rod 210 similarly to the insulation on a typical electrical wire.

In some embodiments, at least one appendage may attach to the at least one protrusion 104. The at least one appendage may include, without limitation, fruit, nuts, stars, animals, snowflakes, and figurines. For example, without limitation, pine tree needles, garland, and leaves may cover each rod to give the illusion of branches from a tree. An occasional figurine may also extend from each rod 210 to provide additional decorative effects. In some embodiments, at least one illumination portion 102 may extend from the at least one rod 210. The at least one illumination portion 102 may include, without limitation, light emitting diodes, bulbs, candles, etc. The power source from the electrical socket, which joins with the base portion 200, may power the at least one illumination portion 102. The at least one illumination portion 102 may include various types of bulbs, including, without limitation, incandescent, fluorescent, C6, C7, M6, and G12. In one embodiment, the synergy created between the at least one illumination portion 102, the at least one protrusion 104, and the malleable shape of the at least one rod 210 may create a visual effect of a Christmas tree.

Figure 4A:
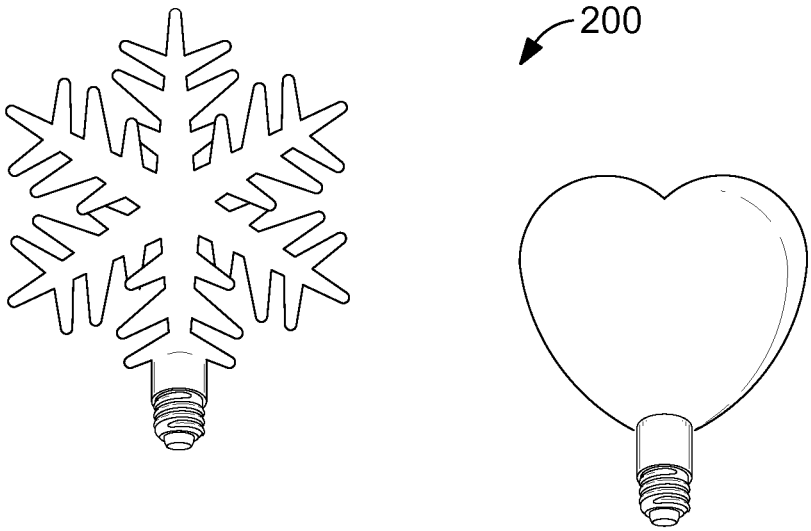
FIGS. 4A and 4B illustrate detailed perspective views of exemplary alternative embodiments of a base portion, in accordance with an embodiment of the present invention.
Figure 4B:
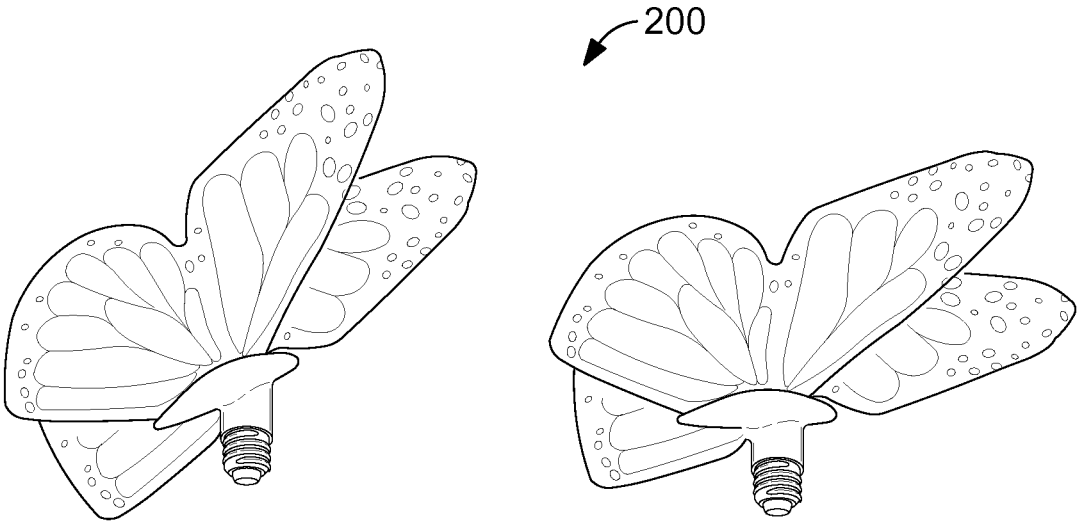
Figure 5A:
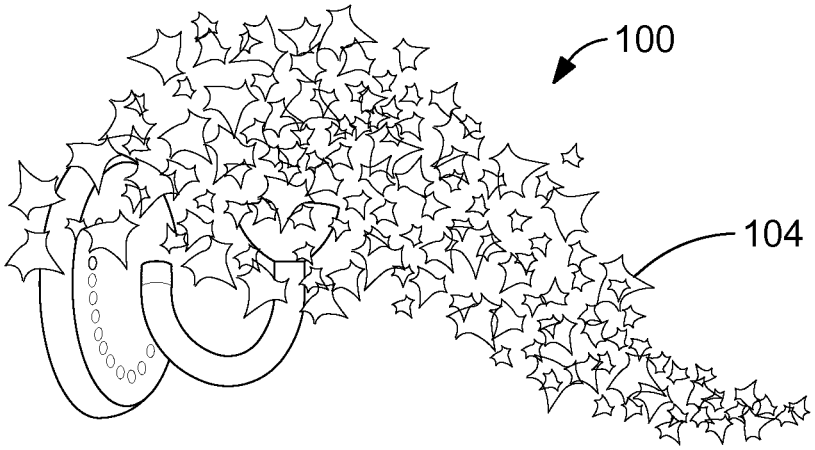
FIGS. 5A, 5B, 5C, and 5D illustrate detailed perspective views of exemplary alternative embodiments of decorative systems, in accordance with an embodiment of the present invention.
Figure 5B:
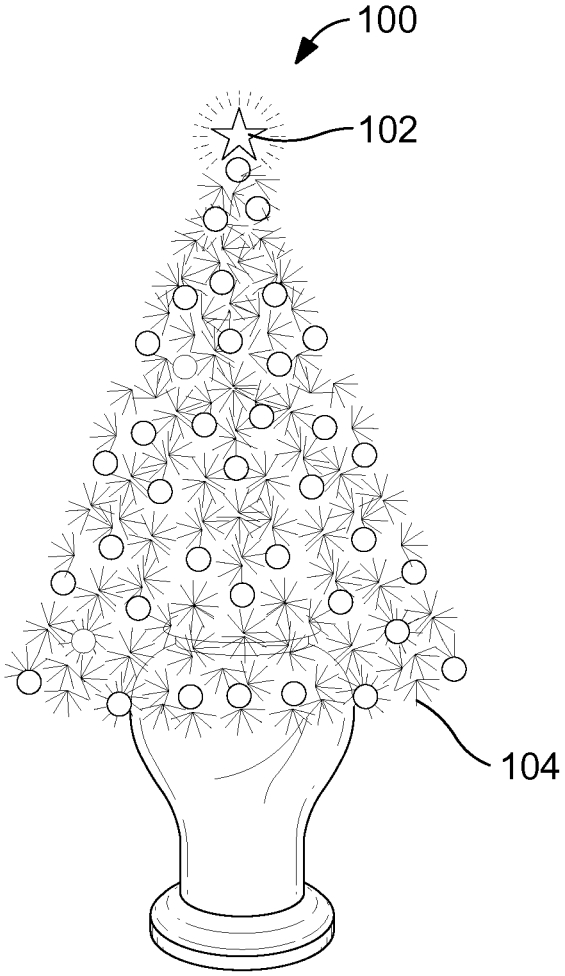
Figure 5C:
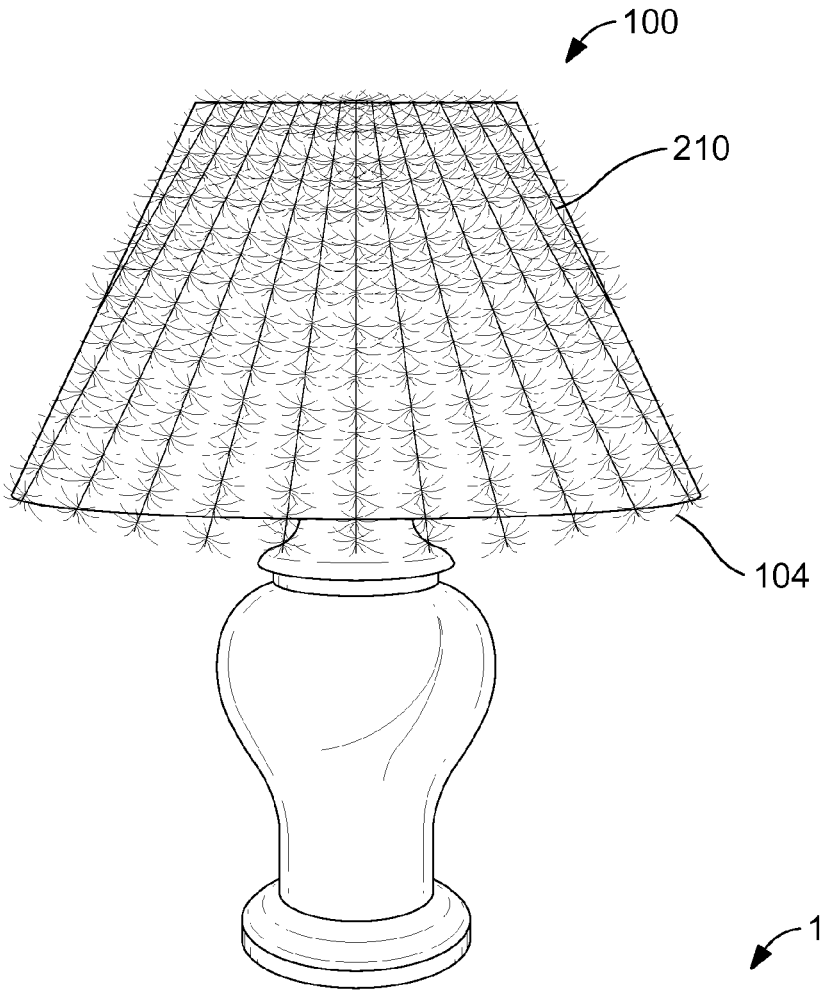
Figure 5D:
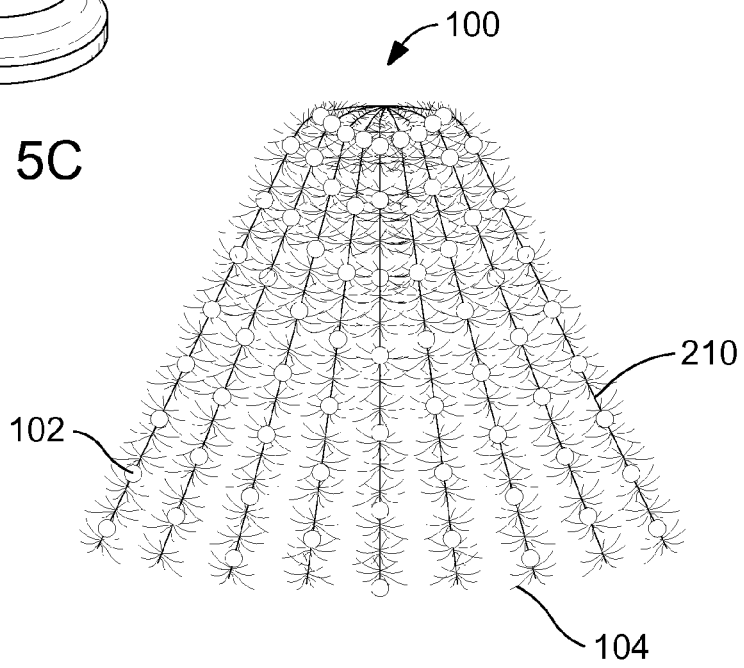

FIGS. 4A and 4B illustrate detailed perspective views of exemplary alternative embodiments of a base portion 200, in accordance with an embodiment of the present invention. In the present invention, the base portion 200 may be configured in various shapes and dimensions, including, without limitation, a heart, a flower, an animal, and a butterfly. Nonetheless, the basic feature of a mounting end that engages a power source and a neck end that exhibits aesthetic features remains the same. Those skilled in the art, in light of the present teachings, will recognize that the base portion 200 may receive power from the electrical socket, or contain a portable power source. In some embodiments the base portion 200 may include, without limitation, Edison Screws of various sizes and types such as but not limited to Lilliput, Miniature, Mini-Candelabra, Candelabra, Small, Intermediate, Medium one-inch, Medium, Admedium, Single Contact and Goliath. Some bases may also comprise a base that does not comprise an Edison Screw such as but not limited to, a base powered by batteries, or a base that an electrical cord can be plugged into, or a base that features an electrical cord that mat be plugged into an electrical socket such as, but not limited to, the electrical sockets on household walls.

FIGS. 5A, 5B, 5C, and 5D illustrate detailed perspective views of exemplary alternative embodiments of decorative system 100, in accordance with an embodiment of the present invention. In the present embodiments, the decorative system 100 may be shaped and dimensioned into a plethora of decorative designs. The malleable characteristics of the at least one rod 210 allow for an eclectic assortment of potential designs. The color pattern of the at least one rod 210 and/or the external covering also create flexibility in designing a desired shape. The decorative system 100 may configure the at least one illumination portion 102 along the at least one rod 210 to provide additional options for the desired design. For example, without limitation, the decorative design may include an aesthetic plant covering a lamp shade, an artificial plant with lights, and a large illumination portion, such as a star that positions over a plant design.

In one alternative embodiment, the decorative system 100 may be configured on a large scale to cover a building, whereby the at least one rod 210 wraps around the building and provides aesthetics. In yet another alternative embodiment, the decorative system 100 may include an audio portion for emitting audio signals in conjunction with the at least one illumination portion 102. In yet another alternative embodiment, a plurality of base portions 200 may create a synergy with each other to enhance the decorative effects.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing a decorative system that provide malleable decorative rods that bend, illuminate, and extend from an electrical base to form a decorative object according to the present invention will be apparent to those skilled in the art. Various aspects of the invention have been described above by way of illustration, and the specific embodiments disclosed are not intended to limit the invention to the particular forms disclosed. The particular implementation of the signaling system that provide malleable decorative rods that bend, illuminate, and extend from an electrical base to form a decorative object may vary depending upon the particular context or application. By way of example, and not limitation, the decorative system that provide malleable decorative rods that bend, illuminate, and extend from an electrical base to form a decorative object described in the foregoing were principally directed to a Christmas tree simulation system; however, similar techniques may instead be applied to configuring colorful and creative decorations for holiday wreaths, birthday decorations, and wedding decorations, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A system comprising:

a base portion, said base portion being configured to provide a foundation for said system, said base portion further being configured to at least partially provide power to said system, said base portion comprising an integrated mounting end, said mounting end being disposed to join with a power source, said base portion further comprising an integrated neck end, said neck end comprising an integrated cover, said cover being configured to regulate access to an interior portion of said base portion, said cover comprising a plurality of apertures; and a plurality of rods, said plurality of rods being configured to at least partially extend from said a plurality of apertures, said plurality of rods being operable to at least partially bend, said rod plurality of rods comprising a plurality of protrusions, said plurality of protrusions being configured to provide a decorative feature, said plurality of rods further comprising a plurality of illuminations, said illumination plurality of illuminations being operable to at least partially illuminate said rod plurality of rods;

wherein the plurality of rods are disposed such that said rods initially extend perpendicular to said cover for a few inches, then bend at a 45 degree downward to form the shape of a tree.

2. The system of claim 1 in which said system comprises a Christmas tree shape and design.

3. The system of claim 1, in which said base portion comprises an Edison screw base.

4. The system of claim 1, wherein said mounting end is operable to rotate in a first direction for urging said base portion downwardly into engagement with an electrical socket.

5. The system of claim 1, in which said neck end comprises a perimeter ridge.

6. The system of claim 1, in which said cover comprises a thermoset melamine material.

7. The system of claim 1, wherein said plurality of rods extend from said plurality of apertures.

8. The system of claim 1, in which said plurality of apertures comprises an insulated ring.

9. The system of claim 8 wherein said insulated ring forms a tight fit around said plurality of rods.

10. The system of claim 1, in which said plurality of rods comprises wires.

11. The system of claim 1, in which said plurality of rods comprise external coverings.

12. The system of claim 11, in which said external coverings comprise a forest green color.

13. The system of claim 12, in which said external coverings comprise polypropylene.

14. The system of claim 1, in which said plurality of protrusions resembles a plurality of pine needles.

15. The system of claim 1, wherein said plurality of pipe needles are fire proof.

16. The system of claim 1, in which said plurality of illuminations comprise a plurality of light emitting diodes.

17. The system of claim 1, in which said plurality of illuminations comprise a C6 and/or a C7 and/or a M6 and/or a G12 type bulb.

18. A system consisting of:

means for joining an integrated mounting end of a base portion with an electrical socket;

means for joining a plurality of rods with an integrated neck end of said base portion;

means for bending said plurality of rods to a shape of a tree; and means for illuminating a plurality of illumination portions from said plurality of rods.

19. A system consisting of:

a base portion, said base portion comprising an Edison screw base, said base portion being configured to provide a foundation for said system, said base portion further being configured to at least partially provide power to said system, said base portion comprising an integrated mounting end, said mounting end being disposed to join with a power source, said power source comprising an electrical socket, said mounting end being operable to rotate in a first direction for urging said base portion downwardly into engagement with said electrical socket, said base portion further comprising an integrated neck end, said neck end comprising an integrated cover, said cover being configured to regulate access to an interior portion of said base portion, said cover comprising a plurality of apertures, said plurality of apertures, comprising an insulated ring; and a plurality of rods, said plurality of rods comprising wires, said plurality of rods being configured to at least partially extend form said plurality of apertures, said plurality of rods being operable to at least partially bend, said plurality of rods being disposed to extend from said plurality of apertures such that said rods initially extend perpendicularly for a few inches then bend downward at a 45 degree angle to form a shape of a tree, said plurality of rods comprising a plurality of protrusions, said plurality of protrusions being configured to provide a decorative feature, said plurality of protrusions comprising a plurality of strands of garland, said plurality of rods further comprising a plurality of illuminations, said plurality of illuminations being operable to at least partially illuminate said plurality of rods, said plurality of illuminations comprising a plurality of light emitting diodes.

* * * * *